US005586839A

United States Patent [19]

Gillespie

[11] Patent Number: 5,586,839

[45] Date of Patent: Dec. 24, 1996

[54] YIELDABLE CABLE BOLT

[76] Inventor: Harvey D. Gillespie, 4848 S. 2200 West, Salt Lake City, Utah 84118

[21] Appl. No.: 301,056

[22] Filed: Sep. 6, 1994

[51] Int. Cl.[6] ..... E21D 20/02

[52] U.S. Cl. ..... 405/259.1; 405/259.5; 405/302.2

[58] Field of Search ..... 411/82, 401; 405/259.1, 405/259.2, 259.3, 259.4, 259.5, 259.6, 288, 302.2

[56] References Cited

U.S. PATENT DOCUMENTS

| | | | |
|---|---|---|---|
| 2,850,937 | 9/1958 | Ralston . | |
| 4,360,292 | 11/1982 | Keeler et al. | 405/259.5 X |
| 4,798,501 | 1/1989 | Spies . | |
| 5,230,589 | 7/1993 | Gillespie | 405/259.6 |
| 5,253,960 | 10/1993 | Scott | 405/302.2 |
| 5,259,703 | 11/1993 | Gillespie | 405/259.6 |
| 5,375,946 | 12/1994 | Locotos | 405/259.4 |
| 5,417,521 | 5/1995 | Scott | 405/259.6 |

FOREIGN PATENT DOCUMENTS

| | | | |
|---|---|---|---|
| 146362 | 2/1981 | German Dem. Rep. | 405/259.4 |
| 618328 | 9/1935 | Germany | 405/259.4 |
| 3322346 | 9/1984 | Germany | 405/259.1 |
| 2158538 | 11/1985 | United Kingdom | 405/259.5 |
| 2278902 | 12/1994 | United Kingdom | 405/259.1 |
| 15279 | 8/1993 | WIPO | 405/259.1 |

*Primary Examiner*—John A. Ricci
*Attorney, Agent, or Firm*—Prince, Yeates & Geldzahler

[57] ABSTRACT

A mine tunnel roof bolt is constructed of one or more multi-strand steel cables that form the bolt shaft, the end(s) of which are press-fitted into a sleeve that defines the bolt head. The bolt can be either active (post-installation tensionable) or passive (not post-installation tensionable). Each of the cable bolt shafts includes an enlarged section that is slightly larger than the diameter of the axial bore through the bolt head sleeve so that the cable enlarged section interferes with the bolt head sleeve. The bolt will withstand a predetermined maximum amount of tension load, after which it will yield. Yield is effected by the cable enlarged section's being pulled through the bolt head sleeve, the interference therebetween causing both the sleeve and cable enlarged section to deform. The bolt will maintain its maximum tension load until the cable enlarged section is pulled through the bolt head sleeve. The cable enlarged section is formed by the addition of a spacer sleeve around the cable center strand (king wire) and between the cable center strand and peripheral strands, or by the addition of a cable sleeve around the cable at the appropriate location. Either design will result in the cable enlarged section's having a greater outside diameter than the bolt head sleeve axial bore, to result in the interference as the cable enlarged section is pulled through the bolt head sleeve.

27 Claims, 11 Drawing Sheets

YIELDABLE CABLE BOLT

BACKGROUND OF THE INVENTION

1. Field of the Invention

The present invention relates to mine roof bolts, generally to mine roof bolts constructed of multi-strand steel cable, and in particular relates to such a cable mine roof bolt that will begin to yield without breaking (i.e., extend in length under tension load) after the tension load on the bolt has reached a predetermined maximum amount.

2. Description of the Prior Art

Cable bolts are a relatively recent innovation in the art of mine roof bolts and mine tunnel roof support systems. Each of my previous two U.S. Pat. Nos. 5,230,589 issued Jul. 27, 1993, and 5,259,703, issued Nov. 9, 1993, is directed to a mine tunnel roof cable bolt comprising a length of multi-strand steel cable having a bolt head comprising a tapered compression plug that is pressed into the mating surface of a drive collar to define the bolt head.

U.S. Pat. No. 5,253,960 also discloses a cable bolt design that uses a cable bolt in a system to monitor tension load on the bolt as represented by movement of the bolt head through a mine roof plate.

PCT Published Application No. 92/00639 also discloses the use of a cable as a mine roof bolt, the bolt head being defined by a nut screwed onto threads that are cut or rolled into the outer surfaces of the cable strands.

Neither the cable bolt of my previous patents, U.S. Pat. Nos. 5,230,589 and 5,259,703, nor the cable bolt of PCT Published Application No. 92/00639 is intended to yield (extend in overall length without failure) under tension load. However, certain geological formations above mine tunnels require that the mine roof bolts in the roof support systems yield a certain amount without breaking. In this regard, the bolt of U.S. Pat. No. 5,253,960 is designed to accommodate a small amount (approximately two inches) of linear extension under tension load. This linear extension is effected by slippage of the tapered collar of the bolt head through the center hole of a mine roof plate for the length of the tapered collar, approximately two inches. After that approximate two inch movement, additional tension force will cause the bolt to fail, as in the case of non-yieldable mine roof bolts. In addition, because the bolt "extension" is provided by a tapered collar passing through and deforming the mine roof plate, the force required to effect this movement (extension) of the bolt relative to the mine tunnel roof is not constant, but rather increases at a rate which is dependent upon a number of factors - - - the taper of the bolt collar, original size of the mine roof plate center hole, thickness of the mine roof plate, material of the mine roof plate, etc. As a result, this device is practical only to measure the amount of linear displacement of the bolt head relative to the mine tunnel roof, and this linear displacement only within the length of the tapered section of the bolt head, approximately two inches. If information regarding the load force on the bolt is required, it is necessary to install a crows foot device and approximate the load using a formula that involves the linear bolt head displacement and crows foot resistance force amounts.

In some geological formations above mine tunnels, it is necessary for the roof support system bolts to yield (i.e., extend) up to four feet or more without failure. It is therefore an object of the present invention to provide a yieldable cable bolt that will yield (extend) up to four feet or more in tension without failure.

It is a further object of the present invention to provide such a yieldable cable bolt that will maintain tension up to a pre-determined amount of tension force prior to yield, thereafter maintain this yielding force (load) at a near constant value throughout the yielding process.

It is another object of the invention to provide a yieldable cable bolt which will provide a way of easily visually measuring the amount of yield (axial displacement of the bolt relative to the mine tunnel roof).

DESCRIPTION OF THE PREFERRED EMBODIMENT

Figure 1:
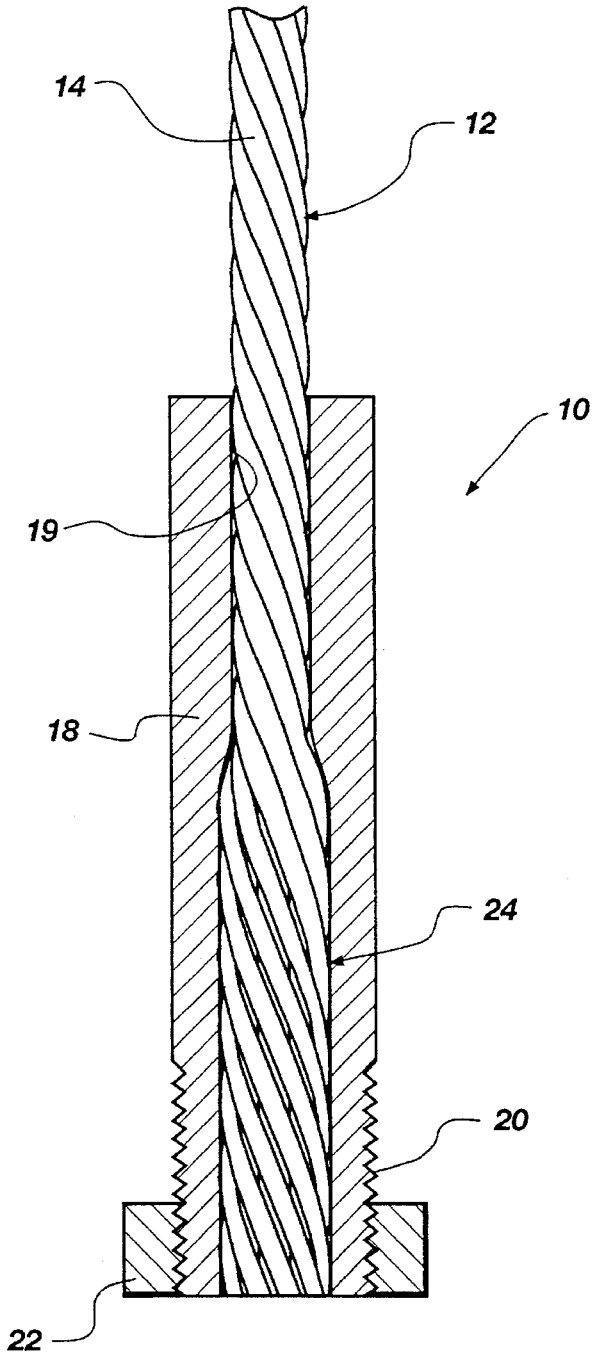
FIG. 1 is a partial sectional view of the yieldable cable bolt of the present invention, illustrating the multi-strand cable, enlarged cable section, and outer sleeve defining the bolt head.

Referring now to the drawings and initially to FIG. 1, the yieldable cable bolt of the prevent invention is shown, generally illustrated by the numeral 10. The yieldable cable bolt comprises a shaft 12, comprising a length of steel stranded cable, which in the embodiment shown, is made up of six peripheral steel strands 14 spirally wrapped around a center steel strand 16 (More clearly shown in FIG. 2.).

In a first embodiment of the yieldable cable bolt of the present invention, the bolt head is formed of an outer sleeve 18 having the cable shaft 12 pressed therein. This outer sleeve 18 may be of any desired length suitable for providing the desired amount of bolt yield as the rock formation above the mine tunnel roof (not shown) shifts. Typically, the length of the outer sleeve 18 can be anywhere from one foot to four feet or longer. Also typically, the outer diameter of the outer sleeve 18 is generally slightly less than the diameter of the mine tunnel roof bore hole.

The outer sleeve 18 includes a set of external threads 20 at the lower end thereof for receiving a threaded nut 22 thereon. In this embodiment, therefore, the yieldable cable bolt of the present invention is also post-installation tensionable, by virtue of the threaded nut and external thread arrangement.

Figure 2:
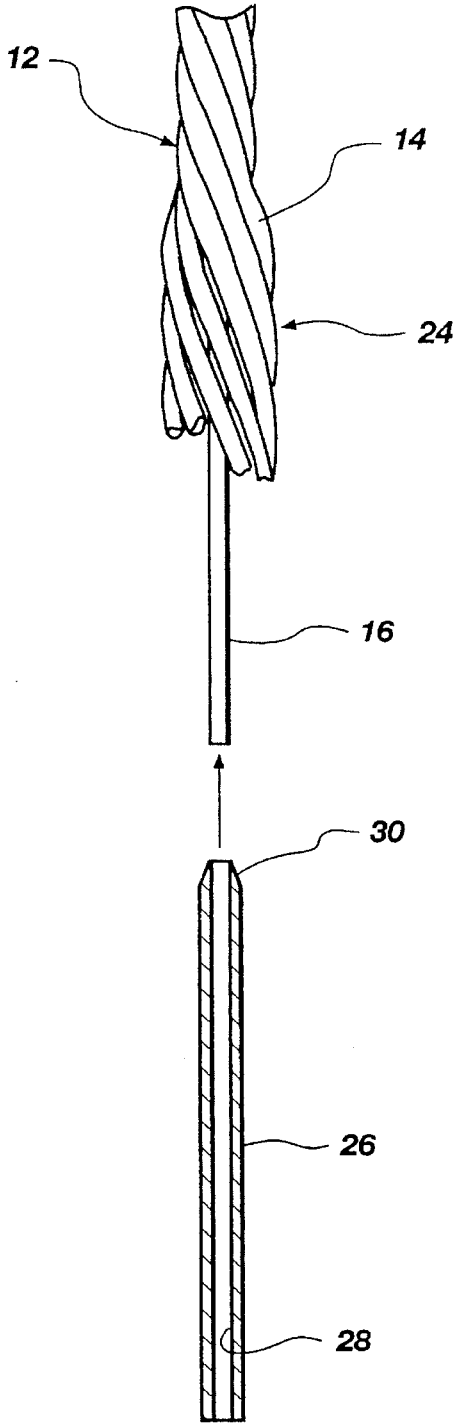
FIG. 2 is a sectional view of the center cable strand sleeve showing the tapered end thereof, and the manner in which the sleeve fits on the center cable strand and between the center strand and the spirally wound peripheral cable strands.

In order that the cable bolt of the present invention actually yield at a pre-determined level of tension force or load, the cable shaft 12 is provided with an enlarged section, generally illusrated at 24. This cable enlarged section 24 may be better understood with reference to FIG. 2, which illustrates the structure for creating the enlarged section. In FIG. 2, the cable peripheral strands 14 are unwound and separated slightly at one end of the cable shaft 12, and a center wire sleeve 26 is slid directly onto the cable center strand 16, sometimes referred to as the king wire. The center wire sleeve 26 is a metal sleeve, formed of metal slightly softer than the steel strands that comprise the bolt shaft cable. The center wire sleeve 26 has an internal bore 28 that is sized to approximate the outside diameter of the cable center strand 16. In addition, the center wire sleeve 26 may include a longitudinal slit therein (not shown) to permit the sleeve to (1) expand slightly to facilitate installation onto the cable center strand, and (2) compress and deform slightly as the cable enlarged section 24 is pressed into the outer sleeve 18 to form the yieldable cable bolt, and as the cable enlarged section is pulled through the outer sleeve as the cable bolt yields. The cable enlarged section has an overall outside diameter that is slightly greater than the inside diameter of the outer sleeve axial bore 19, in order to create material interference between the cable enlarged section and the outer sleeve axial bore.

As shown in FIG. 2, the center wire sleeve 26 is slipped directly onto the cable center strand 16 (the cable peripheral strands having been unwound slightly and separated from the center strand), and the cable peripheral strands rewound directly over the center wire sleeve in order to define the cable enlarged section adjacent the end of the cable. The resulting outside diameter of the cable enlarged section 24 is slightly larger than the diameter of the original internal bore 19 through the outer sleeve 18. This original outer sleeve internal bore 19 is generally of a diameter equal to or slightly greater than the cable diameter, so that the bolt cable can relatively easily be pulled through the outer sleeve, but that the cable enlarged section 24 interferes with the outer sleeve because its diameter is greater than the outer sleeve internal bore. This interference between the cable enlarged section 24 and the outer sleeve axial bore causes the outer sleeve axial bore and the center wire sleeve 26 to deform slightly as tension load pulls the cable enlarged section through the outer sleeve, and, of course, provides the resistance to tension load applied to the cable bolt.

The preferred embodiment of the center wire sleeve 26 includes a tapered conical surface 30 at one end thereof for providing a smooth transition of the outside diameter of the cable shaft 12 to the cable enlarged section 24. Those skilled in the art will readily appreciate that this transition from the cable diameter to the outer diameter of the cable enlarged section provided by the center wire sleeve tapered conical surface 30 eliminates the possibility of forming nicks in the peripheral cable strands 14 otherwise caused by a non-tapered surface at the (upper) end of the center wire sleeve, which peripheral strand nicks would tend to weaken the peripheral cable strands and initiate fractures in the peripheral cable strands as increased tension load is put on the yieldable cable bolt.

Figure 3:
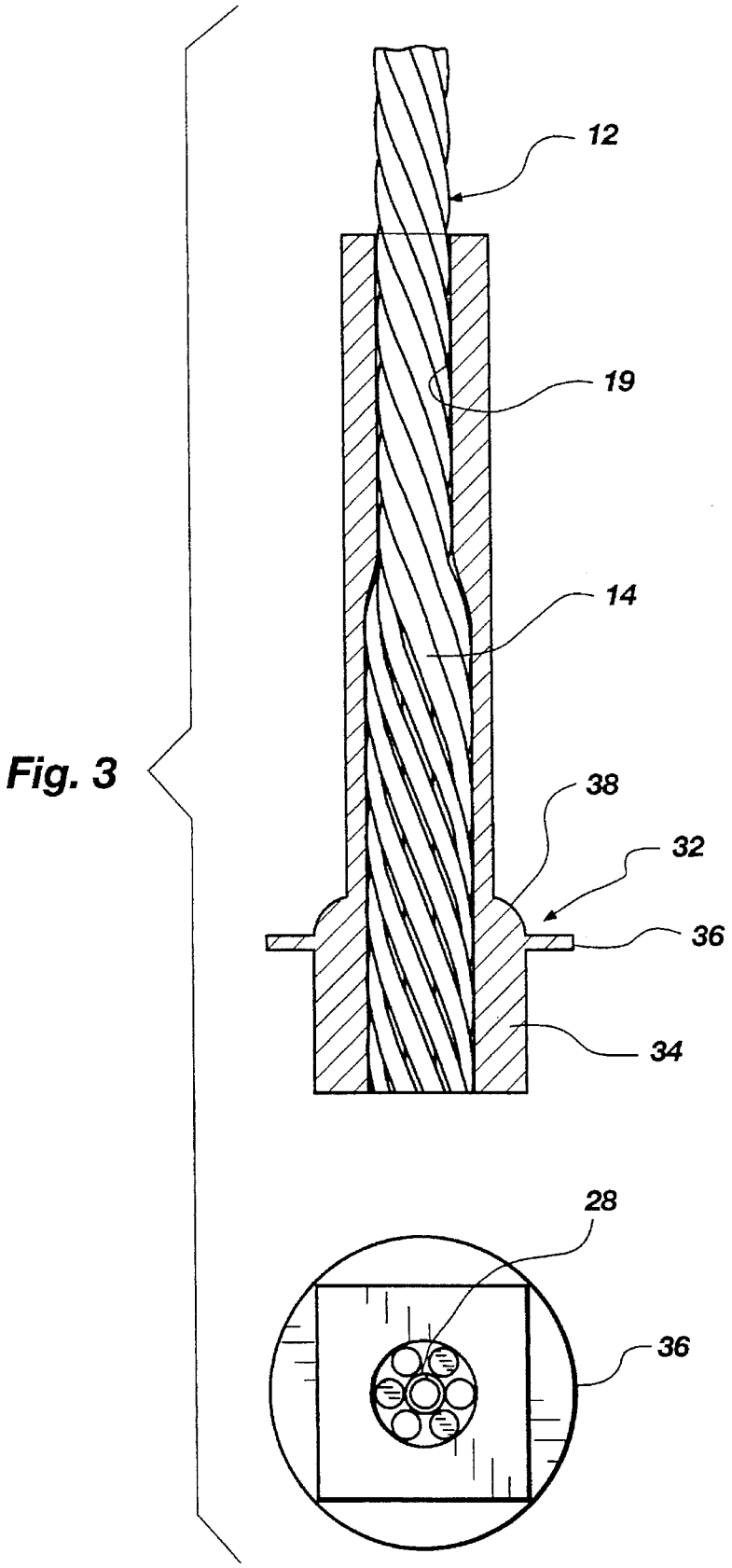
FIG. 3 is a partial sectional view of an alternative outer sleeve, illustrating a square bolt head.

FIG. 3 illustrates a second embodiment of the outer sleeve which forms the head of the yieldable cable bolt of the present invention, this second embodiment of the outer sleeve generally illustrated by the numeral 32. This second embodiment outer sleeve 32 results in a bolt that is of the passive type (i.e., not post-installation tensionable), rather than the active type (post-installation tensionable) mine roof bolt, just described. This second embodiment outer sleeve includes a bolt head 34 integrally formed therewith that is designed to fit into a mine roof bolt driver mechanism and boom for inserting the yieldable cable bolt into a bore hole in a mine tunnel roof. This bolt head 34 is shown as a square head in FIG. 3; obviously, a hexagonal head or any other shaped head that accepts the driver mechanism and boom may be used.

This bolt head 34 is integrally formed with the outer sleeve, and preferrably includes a washer 36 formed therewith. In addition, the bolt head and washer may also have integrally formed therewith a semi-spherical section 38 that mates with the angled surface of the through hole of a dome mine roof plate (not shown) to define a "ball and socket"-like mechanism that permits the yieldable cable bolt and dome mine roof plate to pivot relative to each other in order to accommodate irregular mine tunnel roof surfaces and mine roof bore hole directions. This concept will be more readily understood with reference to FIGS. 4 and 5, which illustrated a dome mine roof plate and spherical washer mechanism.

Figure 4:
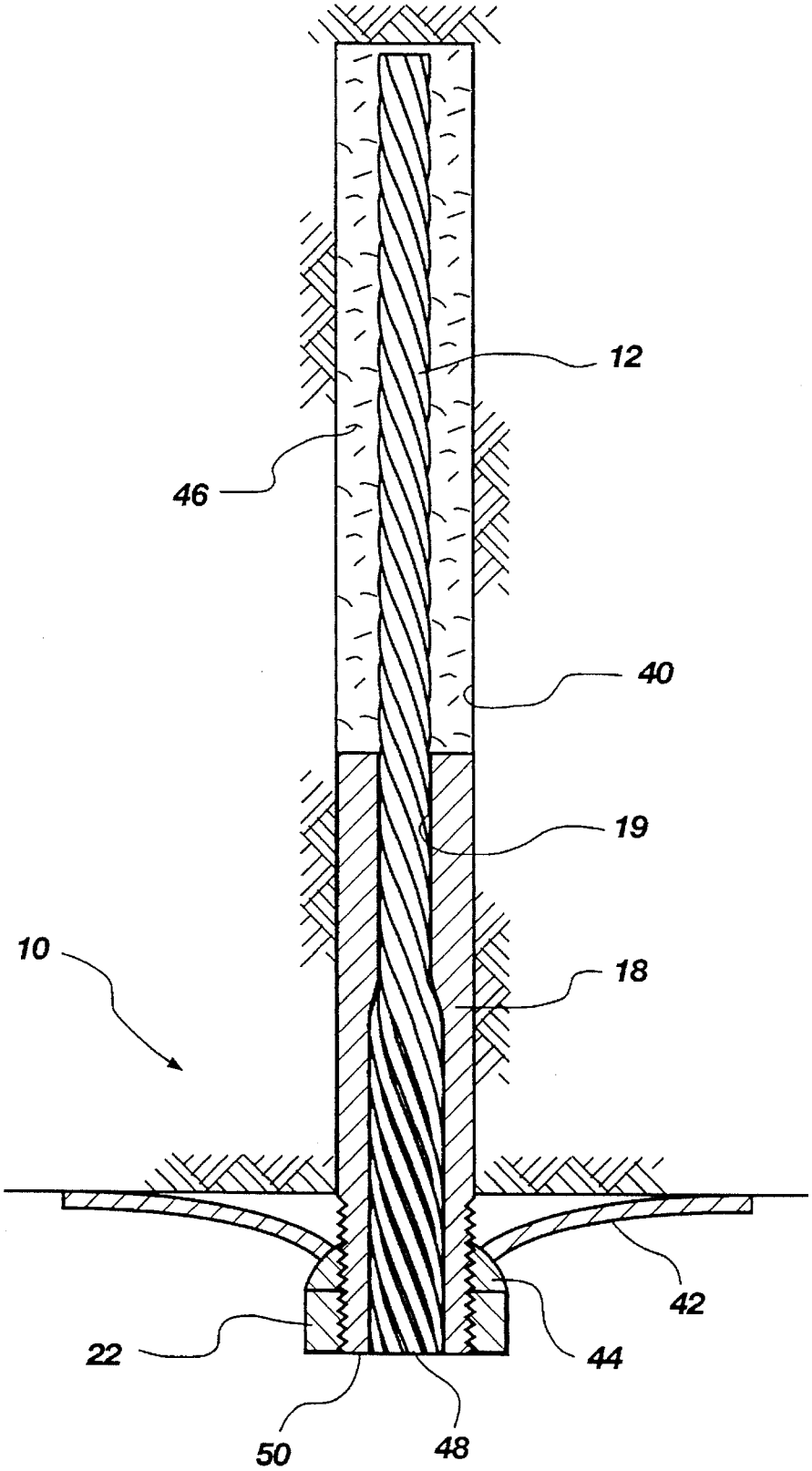
FIG. 4 is a partial sectional view of the cable bolt of FIG. 1, shown installed in the mine roof bore hole, prior to yielding.

FIG. 4 illustrates the yieldable cable bolt of the present invention in a mine tunnel roof bore hole 40. As is common in the industry, a mine roof bolt installation includes a dome mine roof plate 42, and frequently also includes a semi-spherical washer 44.

The yieldable cable mine roof bolt 10 of the present invention is installed in a mine tunnel roof bore hole in the customary manner. Specifically, after the cable shaft has been manually inserted into a mine tunnel roof bore hole behind one or more resin grout material cartridges, the bolt head (i.e., the nut 22) is inserted into the bolt boom and driver mechanism (not shown), and the bolt spun as the bolt driver and boom mechanism forces the bolt up into the mine roof bore hole. This ruptures the resin grout material cartridges, mixes the resin grout material within the annulus around the cable bolt shaft 12, enabling the resin grout material to harden within this annulus within the upper portion of the bore hole in order to retain the cable bolt in position to support the rock formation directly above the mine tunnel roof. This mixed and hardened resin grout material is shown in the annulus around the cable bolt shaft 12 generally at 46.

When the yieldable cable bolt is initially assembled, and when it is initially installed in the mine roof bore hole, the ends of the cable 12 and outer sleeve 18 (bottom ends as shown in FIG. 4) are essentially coplanar. As the cable bolt is being spun into the bore hole, the nut 22 may or may not turn on the outer sleeve external threads 20. Whether or not this happens is left to the discretion of the installer by his use of what is called a dome-tension nut, a shear pin nut, reverse spin on the bolt driver mechanism, reverse (i.e., left hand) threads 20, etc. In any event, it should be understood that when the yieldable cable bolt is initially installed in the mine tunnel roof bore hole, the bottom end 48 of the cable 12 is essentialy coplanar with the bottom end 50 of the outer sleeve 18. The importance of this will be explained with reference to FIG. 5.

Figure 5:
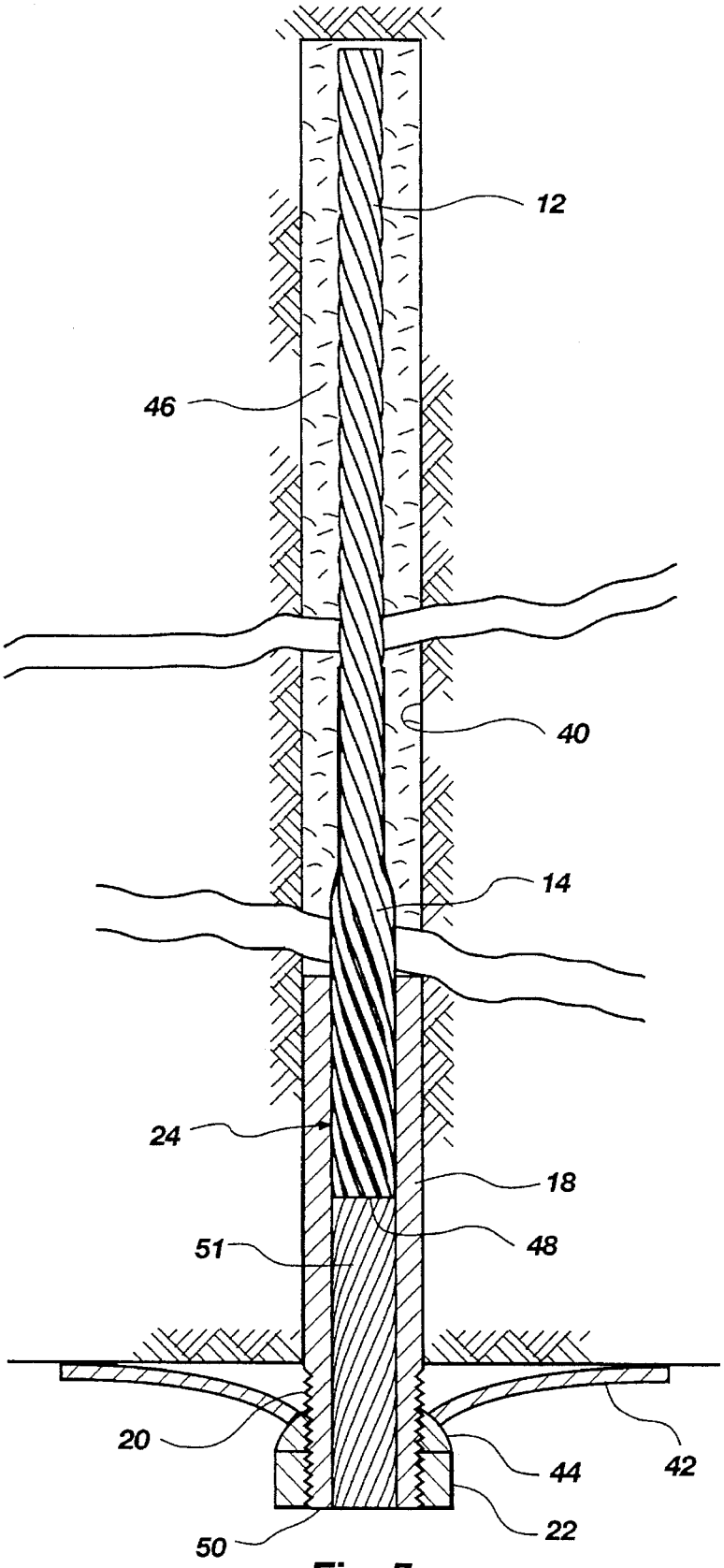
FIG. 5 is a view similar to FIG. 4, illustrating the "yielded" cable pulled up into and through the outer sleeve.

FIG. 5 is a view similar to FIG. 4, and illustrates the concept of the yieldable cable bolt of the present invention, specifically that the cable bold "yields" (i.e., extends in length without failing) at a pre-determined amount of axial tension force (load) applied to the bolt. This yielding is effected by the mechanism previously described with reference to FIGS. 1 and 2. Specifically, even under sizable tension loads, the head of the bolt (the mine roof plate 42, washer 44 and nut 22 on the outer sleeve 18) remains firmly in place at the bore hole opening in the mine tunnel roof. The cable shaft 12, however, yields at the pre-determined amount of tension load, and begins to slide upwardly within the axial bore 19 of the outer sleeve 18. Inasmuch as there is actual interference between the cable shaft 12 at the location of the enlarged section 24 because the enlarged section outside diameter is slighly greater than the outer sleeve inside bore diameter, the yieldable cable bolt provides considerable resistance to the tension load, the amount of this resistance being determined by the relative sizes and geometries of the cable shaft 12, the outer sleeve 18, and the center wire sleeve 26, as previously described.

As shown in FIG. 5, the rock formation above the mine tunnel roof has shifted significantly, creating a sizable tension load on the yieldable cable bolt. In response to this increased tension load, the cable bolt shaft 12 has "yielded" relative to the outer sleeve 18, and has pulled part of the way through the outer sleeve. This desired tension load and yield amount (distance) are dictated by the particular rock formation above the mine tunnel roof to be supported. With this information, of course, a yieldable cable bolt of the present invention can be fashioned to yield at the desired tension load, and maintain this load for as much yielding bolt extension (distance) as is required in the particular application.

FIG. 5 illustrates another aspect of the yieldable cable bolt of the present invention. This aspect is the ability to easily determine the amount of cable bolt yield, i.e., the actual distance the bolt shaft cable has been displaced relative to its initial position within the outer sleeve 18. As call be appreciated, generally the bolt head (outer sleeve, nut, dome mine roof plate) does not move (vertically) relative to the surface of the mine tunnel roof. Therefore, the amount of cable bolt yield can be determined by measuring the distance the cable has traveled within the outer sleeve relative to its initial position when the bolt was installed. This yield amount is readily measurable as the distance between the bottom end of the cable 48 and the bottom end of the outer sleeve 50. The interested miner can simply insert a tape measure up into the outer sleeve axial bore until its end touches the cable end 48, and read the yield (distance) amount at the outer sleeve end 50. This yielding, of course, is necessary in certain rock formations, and it is necessary to monitor the amount of yield in order to determine if and when the rock formation above the mine tunnel roof requires additional structural reinforcing.

Figure 6:
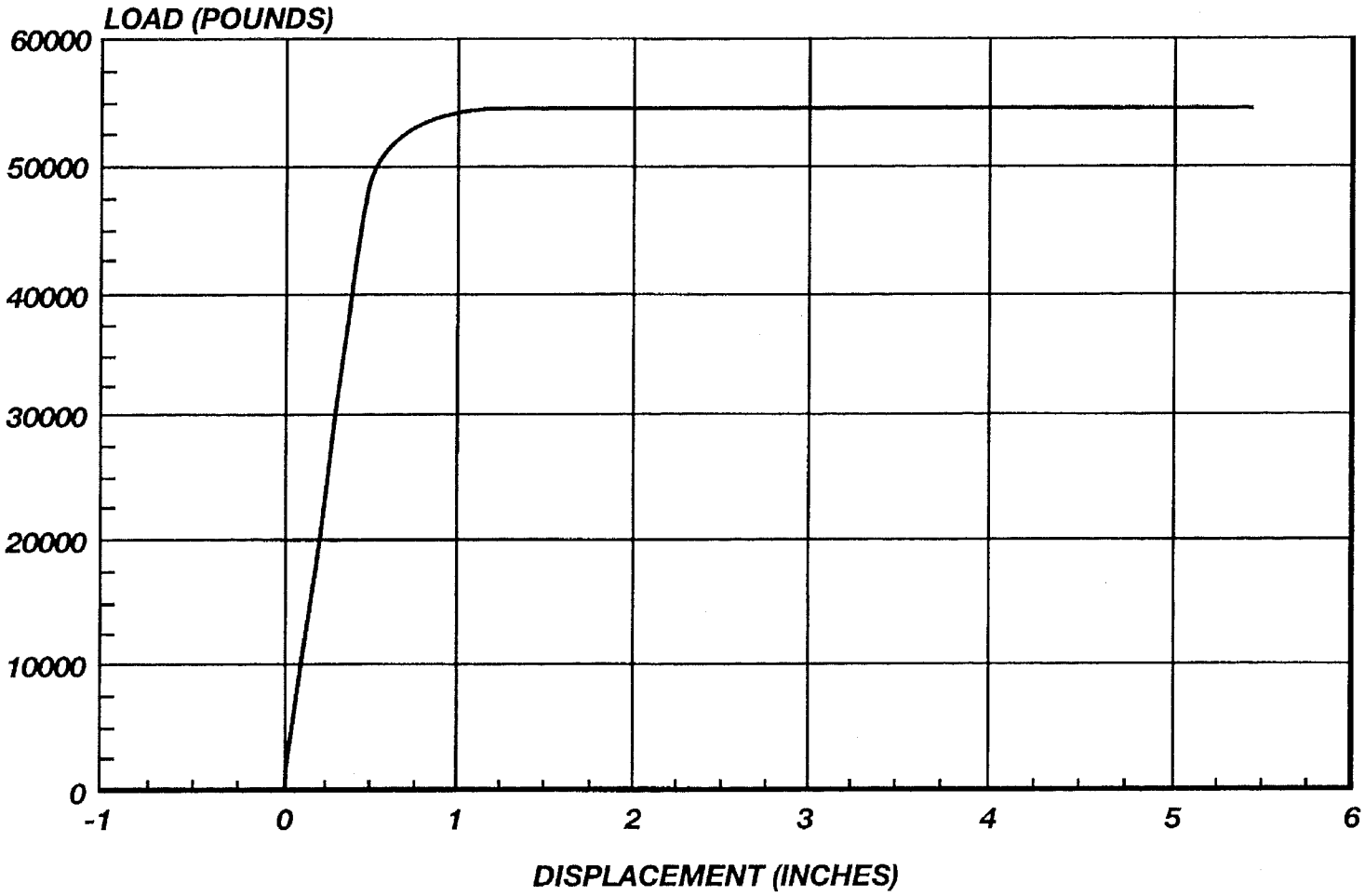
FIG. 6 is a graph of tension load versus elongation (displacement within the outer sleeve) for a 0.600 diameter steel cable bolt.

FIG. 6 is a typical graph of tension load applied to a tensionable cable bolt versus yield (amount of displacement or overall bolt elongation). As shown, as the tension load on the bolt increases, bolt elongation (yielding) is minimal (up to approximately one-half inch) until, for example, approximately 55,000 pounds of load is reached. At approximately 55,000 pounds of load, the bolt begins to yield. This yielding is in actuality, displacement of the cable shaft 12, and specifically the cable enlarged section 24, relative to the outer sleeve 18, as the cable enlarged section slides within the outer sleeve. It also should be noted that this yielding (displacement of the cable shaft relative to the outer sleeve) occurs while the tension load on the yieldable cable bolt maintains a constant level at approximately 55,000 pounds.

As shown in FIG. 6, this approximate 55,000 pound tension load on the cable is maintained throughout its entire range of yielding. This range (distance) of yielding is determined by the distance that the cable enlarged section 24 travels within the outer sleeve 18. Those skilled in the art will readily appreciate that, as the cable enlarged section 24 begins to exit the opposite end of the outer sleeve 18, the tension load provided by the cable bolt will drop in an approximate linear relationship as the cable enlarged section exits the outer sleeve. It can therefore be appreciated that the amount of tension load at which the yieldable cable bolt of the present invention is intended to yield is determined by the specific relative geometrics of the cable, the center wire sleeve, and the outer sleeve.

Returning briefly to FIG. 5, it can be appreciated that, as the bolt shaft cable 12 is pulled through the outer sleeve 18, the peripheral cable strands 14 at the cable enlarged section 24 form corresponding parallel spiral grooves 51 in the outer sleeve axial bore, due of course, to the designed interference between the cable enlarged section and the outer sleeve. Because the peripheral cable strands are spirally wound, the corresponding parallel grooves 51 are also formed spirally in the outer sleeve axial bore. The result is a set of mating "self threads" that cause the cable enlarged section 24 to rotate relative to the outer sleeve 18 as the bolt shaft cable 12 is pulled through the outer sleeve. Inasmuch as the cable 12 is resin grouted in the bore hole, it cannot rotate. Therefore, unless the outer sleeve 18 is permitted to rotate relative to the cable, the cable (at the location of the enlarged section) will tend to unwind as it is pulled through the outer sleeve.

To prevent cable unwinding as the cable enlarged section is pulled through the outer sleeve, the inventor has determined that, if the outer sleeve external threads 20 are oriented in the same direction as the wind of the cable, the outer sleeve will be permitted to "unscrew" from the nut 22 as the cable enlarged section's pulling through the outer sleeve causes the outer sleeve to rotate. If the spirally wound steel cable is wound in the right-hand direction, the "threads" formed by the peripheral cable strands are left-hand. Therefore, right-hand threads 20 on the outer sleeve will enable the outer sleeve to rotate in the clockwise direction (as viewed from the bolt head) relative to both the bolt shaft cable 12 and the nut 22. With right-hand threads 20 on the outer sleeve, this relative rotation will "unscrew" the nut from the outer sleeve to permit the outer sleeve to rotate.

Those skilled in the art will appreciate that, as a practical matter, the nut 22 will never totally unscrew itself from the outer sleeve due to the fact that the leads of the outer sleeve threads 20 and the cable "threads" are drastically different. Specifically, approximately eight inches of linear yield of a typical cable within the outer sleeve will result in one full rotation of the outer sleeve. By contrast, one full rotation of the outer sleeve relative to the nut 22 results only in approximately one-eighth inch of linear travel. Because the outer sleeve 18 is generally up to only four to five feet in length, the outer sleeve could rotate only approximately seven full turns for the entire length of the cable within the outer sleeve. Seven rotations of the nut on the outer sleeve would back the nut off less than one inch, well within the length of threads generally provided on the outer sleeve.

Figure 7:
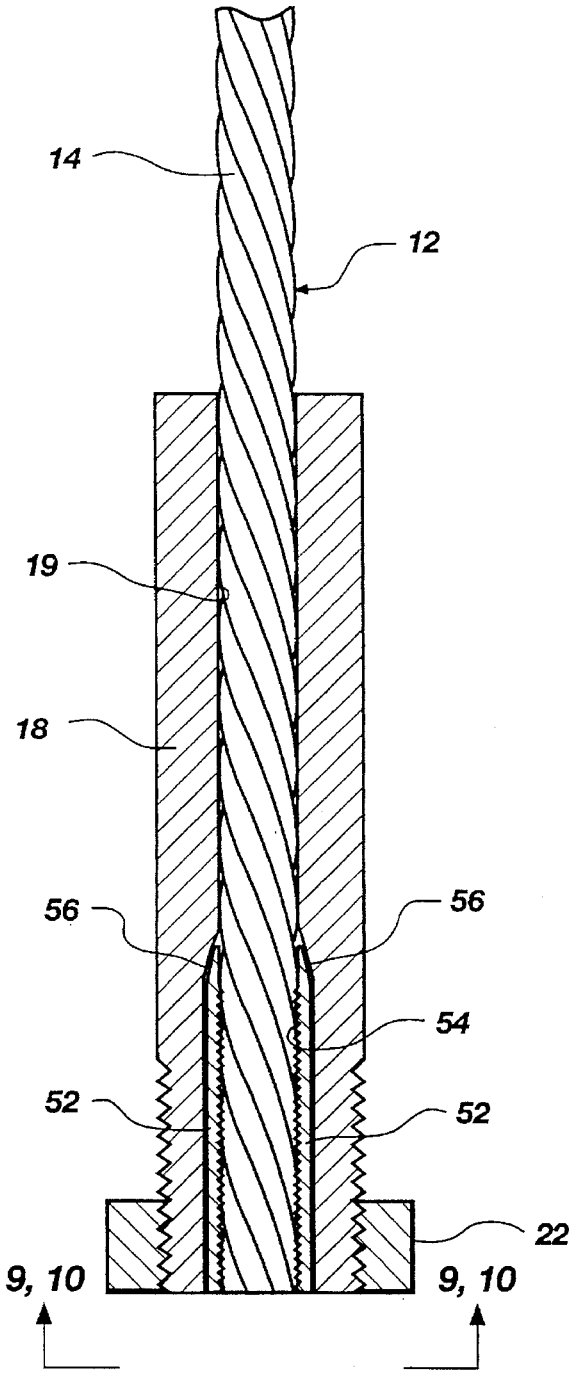
FIG. 7 is a view similar to FIG. 1 of an alternative embodiment yieldable cable bolt, illustrating the cable sleeve.

FIG. 7 is a view similar to FIG. 1, illustrating an alternative embodiment of the yieldable cable bolt of the present invention. The cable bolt of the embodiment of FIG. 7 does not include the cable enlarged section which was created by the center wire sleeve positioned around the cable center strand and under the cable peripheral strands. Rather, the enlarged section of the cable is formed by the addition of a cable sleeve 52 positioned directly around the cable shaft 12 at the threaded (lower) end of the outer sleeve 18. In this embodiment, the cable sleeve 52 may be formed in a single cylindrical piece, two essentially identical semi-cylindrical sleeve-like pieces, or three essentially identical arcuate sections. With a single cylindrical piece cable sleeve 52, the cable sleeve includes a longitudinal slit (not shown) therein to enable the sleeve to (1) expand slightly to facilitate installation onto the cable, and (2) compress slightly as the cable and sleeve are pressed into the outer sleeve 18 to form the yieldable cable bolt, and as the cable and sleeve are pulled through the outer sleeve as the cable bolt yields.

Whether the cable sleeve 52 is constructed of a single cylindrical piece, two semi-cylindrical pieces, or three identical arcuate sections, the cable sleeve is preferably formed with a series of parallel annular serrations or threads 54 that define the inner tubular surface of the cable sleeve. These serrations or threads 54 are designed to "bite" into the steel cable defining the cable shaft 12 as the cable sleeve 52 is compressed into the outer sleeve 18, and as the cable sleeve is pulled through the outer sleeve as the cable bolt yields.

FIG. 7 also illustrates that the cable sleeve 52 includes an external annular taper 56 on the leading end thereof. This annular taper, of course, facilitates initial insertion of the cable sleeve 52 (positioned around the cable shaft 12) into the end of the outer sleeve 18 to form the yieldable cable bolt, and also facilitates yielding of the cable bolt as the cable shaft and accompanying cable sleeve are pulled through the outer sleeve during cable bolt yield.

Figure 8:
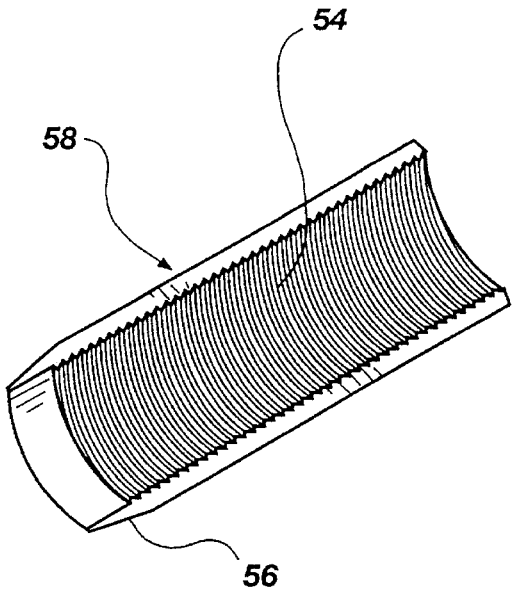
FIG. 8 is a perspective view of a semi-cylindrical cable sleeve section.

FIG. 8 is a perspective view of a semi-cylindrical section 58 of a two-piece cable sleeve similar to that shown in FIG. 7. The perspective view of FIG. 8 more clearly shows the parallel annular serrations 54 within the cable sleeve, and also illustrates the external annular taper 56 on one end of the cable sleeve, as previously described.

Figure 9:
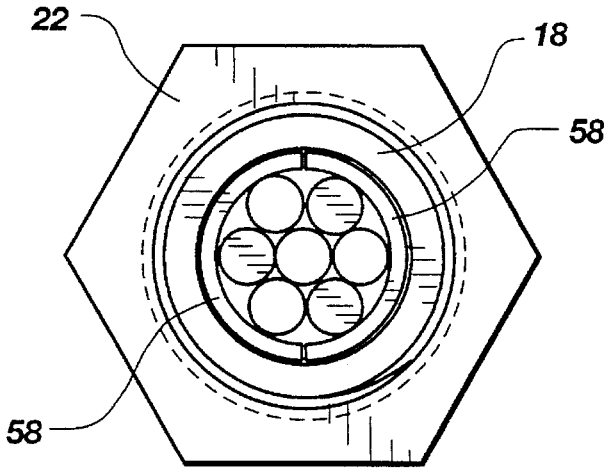
FIG. 9 is an end view of a variation of the embodiment of FIG. 7, taken in the direction of arrows 9 in FIG. 7.
Figure 10:
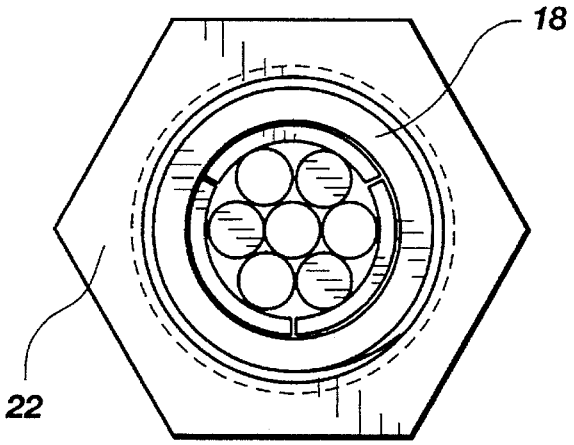
FIG. 10 is an end view of another variation of the embodiment of FIG. 7, taken in the direction of arrows 10 in FIG. 7.

FIGS. 9 and 10 are end views taken in the direction of arrows 9, 10 in FIG. 7, and illustrate the placement of the semi-cylindrical sections 58 of the two-piece cable sleeve (FIG. 9), and the identical sections of the three-piece cable sleeve (FIG. 10). FIGS. 9 and 10 also illustrate the gaps between the identical two- and three-piece cable sleeve sections that permit the cable sleeve sections to compress slightly during insertion of the cable shaft and cable sleeve sections into the outer sleeve 18, and during the yielding of the cable bolt as the cable shaft and cable sleeve sections are pulled through the outer sleeve.

Figure 11:
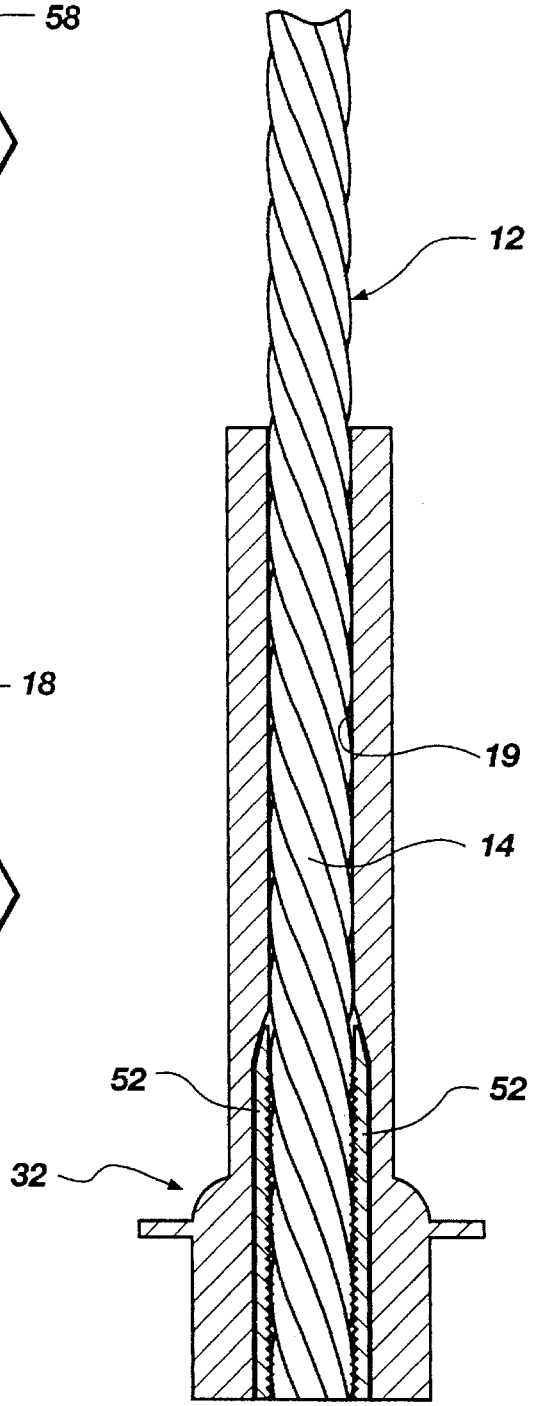
FIG. 11 is a view similar to FIGS. 3 and 7, illustrating the cable sleeve design of FIG. 7 in the square bolt head unitary outer sleeve of FIG. 3.

FIG. 11 is a view similar to FIGS. 3 and 7, illustrating the forged unitary outer sleeve and bolt head 32 of FIG. 3, in combination with the cable sleeve 52 of FIG. 7 positioned on the cable shaft 12 to form the yieldable cable bolt of the present invention. In the FIG. 7 embodiment of the yieldable cable bolt that utilizes the cable sleeve 52 (either a one-, two-, or three-piece), the spiral peripheral strands 14 of the cable shaft do not cause the cable shaft to rotate as yields through the outer sleeve 32. Therefore, it is necessary to utilize the outer sleeve 18 of the design of the first embodiment that includes the threaded nut. Rather, the FIG. 7 embodiment outer sleeve 32 may be used, having its bolt head and washer formed integrally therewith to form what is called a passive yieldable cable bolt for certain rock formation applications.

Figure 12:
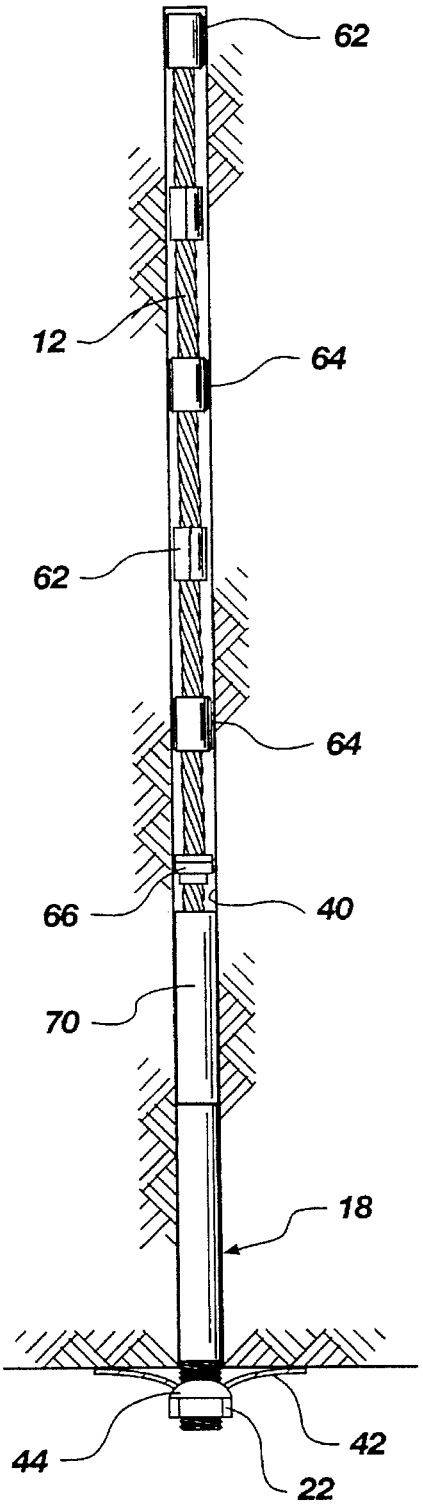
FIG. 12 is a side view of the yieldable cable bolt, illustrating a number of alternative embodiments.

FIG. 12 illustrates a number of further alternative embodiments in the yieldable mine roof bolt of the present invention. As in the previous embodiments of FIGS. 1–11, the yieldable mine roof bolt of FIG. 12 comprises a shaft 12 of a length of multi-strand steel cable having six peripheral strands spirally wrapped around the center strand. The outer sleeve 18 is pressed onto the shank cable 12 to form the yieldable mine roof bolt. The dome mine roof plate 42, spherical washer 44, and nut 22 are also shown positioned about the yieldable cable bolt, and the bolt is in functional position within the mine tunnel roof bore hole 40 prior to post-installation tensioning. For clarity, the mixed resin adhesive material 46 within the annulus around the bolt shaft cable 12 is not shown, for purposes of more clearly explaining the alternative embodiments that function to enhance the ability of the resin adhesive to retain the cable bolt within the bore hole, and therefore to support the rock formation above the mine tunnel.

The first of these retention enhancements comprises one or more anchor sleeves 62 attached to the bolt shaft 12 at various points along the cable. These cable anchor sleeves 62 take the form of steel cylinders that are swaged down upon the bolt shaft cable 12. In one embodiment, the steel cylinder has initial dimensions of one inch outside diameter, five-eighths inch inside diameter and one and one-half inches in length. When this cylinder is swaged down upon a 0.600 diameter stranded steel cable with 500 tons of force, it deforms down into the interstices between the individual peripheral strands of the shaft cable, and is transformed into the cylindrical anchor sleeve 62 having a seven-eighths inch outside diameter and a length of approximately two inches.

Figure 13:
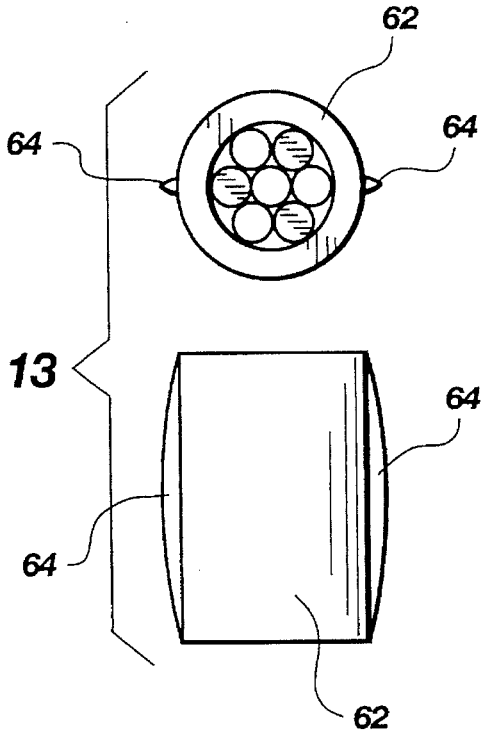
FIG. 13 is a view of an anchor sleeve of the FIG. 12 embodiment.

The steel cylinder that becomes the cable shaft anchor sleeve 62 is swaged onto the cable by a piston-ram swaging device (not shown). The swaging device has a stationary semi-cylindrical die, and an opposing semi-cylindrical die mounted on the ram piston for swaging the steel cylinder onto the cable in diametrical fashion. As a practical matter, the two semi-cylindrical dies are not 100% completely semi-cylindrical. The result is that, when the steel cylinder is swaged onto the shaft cable, swaging causes some of the cylinder material to be forced radially outwardly between the dies, forming two diametrically aligned fins 64 that are subsequently trimmed down to a symmetric diammetric distance that corresponds to the inside diameter of the mine roof bore hole. This is best shown in FIG. 13. For example, the previously described steel cylinder that is swaged down to a seven-eighths outside diameter and two inch long anchor sleeve 62 would have fins 64 approximately one-thirty-second inch thick and one-sixteenth inch wide (radial dimension) for use in a one inch diameter bore hole. Of course, the anchor sleeves, including the fins, can be made to any outside diameter to accommodate the particular bore hole size. These fins 64 serve to center the bolt shaft 12 within the bore hole, and also aid in puncturing the resin cartridge (not shown) and mixing the resin adhesive within the bore hole as the bolt is being rotated and inserted into the bore hole.

In order to insure that these anchor sleeves 62 do not slip along the cable under extreme tension, shallow threads (not shown) may be cut or rolled into the shaft cable at locations where anchor sleeves are to be swaged. Swaging the anchor sleeves onto these "threaded" areas of the bolt shaft cable forces the anchor sleeve material into these threads to totally prevent any axial movement of the anchor sleeves along the cable. As an added measure, the cylinders that become anchor sleeves may also be formed with internal threads (not shown) that can easily align with the shallow cable threads as the anchor sleeves are being swaged onto the cable. This insures optimum grip between the anchor sleeves and the cable.

Once the resin adhesive has been thoroughly mixed and has set within the bore hole, the anchor sleeves 62 are surrounded by hardened resin, and it is then virtually impossible to remove the mine roof bolt from the bore hole. This is because the resin has worked itself into the cracks and crevices within the rock formation in the bore hole, and has also surrounded each of the anchor sleeves 62 along the length of the bolt shaft cable, forming a barrier of solid resin around and below the anchor sleeve and into the rock formation.

FIG. 12 also illustrates another embodiment of the yieldable mine roof bolt of the present invention that can be used either by itself or in conjunction with one or more of the anchor sleeves 62 along the shaft of the bolt. Specifically, this embodiment bolt includes a yieldable grout compactor 66 mounted on the bolt shaft 2. This yieldable grout compactor is of a diameter slightly smaller than the bore hole diameter so that it will ride up into the bore hole as the cable end is inserted into the bore hole. The yieldable grout compactor, of course, functions to dam the flow of resin grout material down the bore hole, in order to (1) compact the resin grout material into the top portion of the bore hole and around the anchor sleeves 62, (2) force all of the air out of the resin grout material, and (3) prevent the resin grout material from seeping down the bore hole wall and away from contact with the cable itself.

As the cable is inserted into the bore hole, the mixture of resin grout material that is being forced down the bore hole through the annulus around the anchor sleeves and cable is forced down against the top portion of the compactor, and causes the compactor to slide downwardly on the cable, against the frictional resistance force between the internal bore of the yieldable grout compactor and the outer surface of the cable. As can be appreciated, the force of the resin grout material above the yieldable grout compactor 66, being pressurized under the force of the end of the cable being forced into the bore hole, evacuates all of the air from within the annulus in the bore hole around the cable and anchor sleeves, around the yieldable grout compactor, and down the bore hole. Because the yieldable grout compactor 66 is sized to be of a diameter slightly less than the inside diameter of the bore hole, the resin grout material will not be forced around the grout compactor, but rather will force the grout compactor to slide downwardly on the cable, thereby compacting the resin grout material above the compactor and preventing the resin grout material from seeping around the compactor and down the bore hole wall. In this manner, the resin grout material is maintained in continuous and uniform contact with both the inside of the bore hole wall and the outer surfaces of the cable and anchor sleeves in order to optimize the adhesion therebetween to retain the cable bolt shaft in functional position within the bore hole.

FIG. 12 illustrates yet another alternative embodiment of the yieldable mine roof bolt of the present invention. The is embodiment incorporates the use of a stiffner sleeve 70, which takes the form of a metal pipe or cylinder. The stiffner sleeve has an inside diameter slightly larger than the outside diameter of the cable shaft 12, and an outside diameter that is essentially the same as the diameter of the borehole (one inch O.D. or one and three-eighths inches O.D., for example). Such an outside diameter the same as the diameter of the bore hole works quite well, inasmuch as, as a practical matter, the actual diameter of the bore hole is generally slightly larger than the indicated drill bit diameter, due to drill bit wobble, etc.

As those skilled in the art can appreciate, the purpose of the stiffner sleeve 70 is two-fold. As a stiffner, it prevents the shaft cable 12 from buckling as the yieldable cable bolt is being inserted into the bore hole, and as the blind end of the shaft 12 "bottoms out" against the resin cartridge(s) (not shown in FIG. 12). It should be appreciated that, as the blind end of the bolt shaft 12 engages the resin cartridge(s), additional linear force is necessary for further inserting the bolt into the bore hole against the resistance provided by the resin cartridge(s). But for the stiffner sleeve 70, the bolt shaft cable 12 could tend to buckle due to this additional linear force, and the stiffner sleeve prevents the cable from buckling.

The second aspect of the stiffner sleeve 70 is that it is a "sleeve" around the shaft cable that protects the cable from abrasive wear from the dome mine roof plate 42 as the cable bolt is rotated and spun during insertion into the bore hole. It can be appreciated that, but for the stiffner sleeve 70, spinning the bolt into the bore hole with the mine roof plate 42 loose causes the inside edge of the mine roof plate to cut and wear into the outer surfaces of the peripheral cable strands 14 at the location on the bolt shaft where the mine roof plate "rides" as the bolt is being spun and inserted into the bore hole.

The inventor has determined that the length of the stiffner sleeve 70 can be anywhere from a minimum of approximately six inches to any desired functional length, typically 10 feet or more. This maximum length, of course, is relative to the overall mine roof bolt length, and may also be in part dictated by the amount (total length of cartridges) of resin adhesive inserted into the bore hole ahead of the mine roof bolt.

Figure 14:
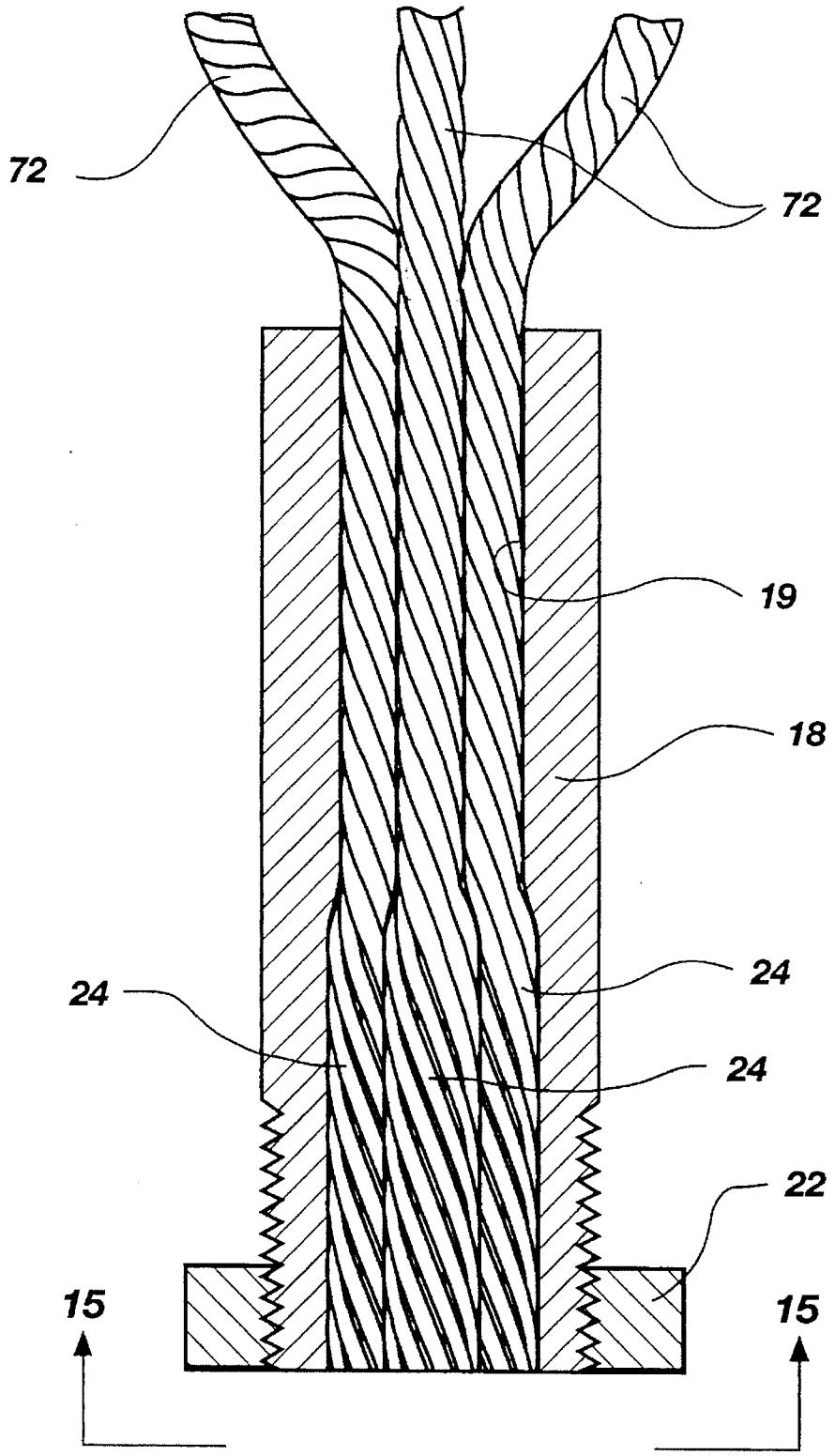
FIG. 14 is a view similar to FIG. 1, illustrating a variation of the present invention that incorporates a plurality of cable bolt shafts utilizing the center wire sleeve design of the cable enlarged sections.

FIG. 14 is a view similar to FIG. 1, illustrating a variation of the yieldable cable bolt of the present invention. This FIG. 14 variation incorporates a plurality of cable bolt shafts (three shown in FIG. 14) that utilize the cable center wire sleeve design to create the cable enlarged sections. The FIG. 14 variation utilizes an outer sleeve 18 as in the embodiments of FIGS. 1 and 7. Obviously, the outer sleeve 18 in the FIG. 14 embodiment may necessarily be larger than those utilizing a single cable design.

The FIG. 14 embodiment utilizes three cable shafts 72, rather than the single cable shaft of previously described embodiments. Obviously, any number of cable shafts may be used, three chosen in this description because three fit nicely into the circular axial bore 19 of the outer sleeve 18. As in the embodiments of FIGS. 1 and 3, the cable shafts 72 of the FIG. 14 embodiment include a center wire sleeve 26 on the center cable strand 16, as has been previously described with reference to FIG. 2. Therefore, each of the cable shafts 72 includes its cable enlarged section 24 for creating interference with the outer sleeve 18 in a manner essentially identical to the yieldable cable bolt embodiments previously described. The only difference is that, in the FIG. 14 embodiment, the cable enlarged section/outer sleeve interference is not continuous around either the outer sleeve or any of the cable enlarged sections. In all other respects, the operation of the FIG. 14 embodiment of the yieldable cable bolt is identical to that of the previously described yieldable cable bolts.

Figure 15:
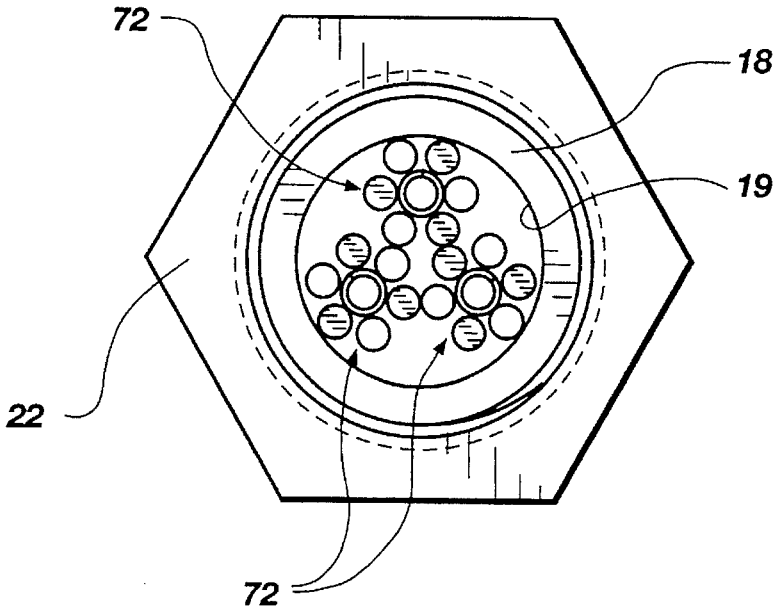
FIG. 15 is an end view of the FIG. 14 design taken in the direction of arrows 15 in FIG. 14.

FIG. 15 is an end view similar to FIGS. 9 and 10, taken in the direction of arrows 15 in FIG. 14. FIG. 15 shows the relative position of the three cable shafts 72 within the outer sleeve axial bore 19.

Figure 16:
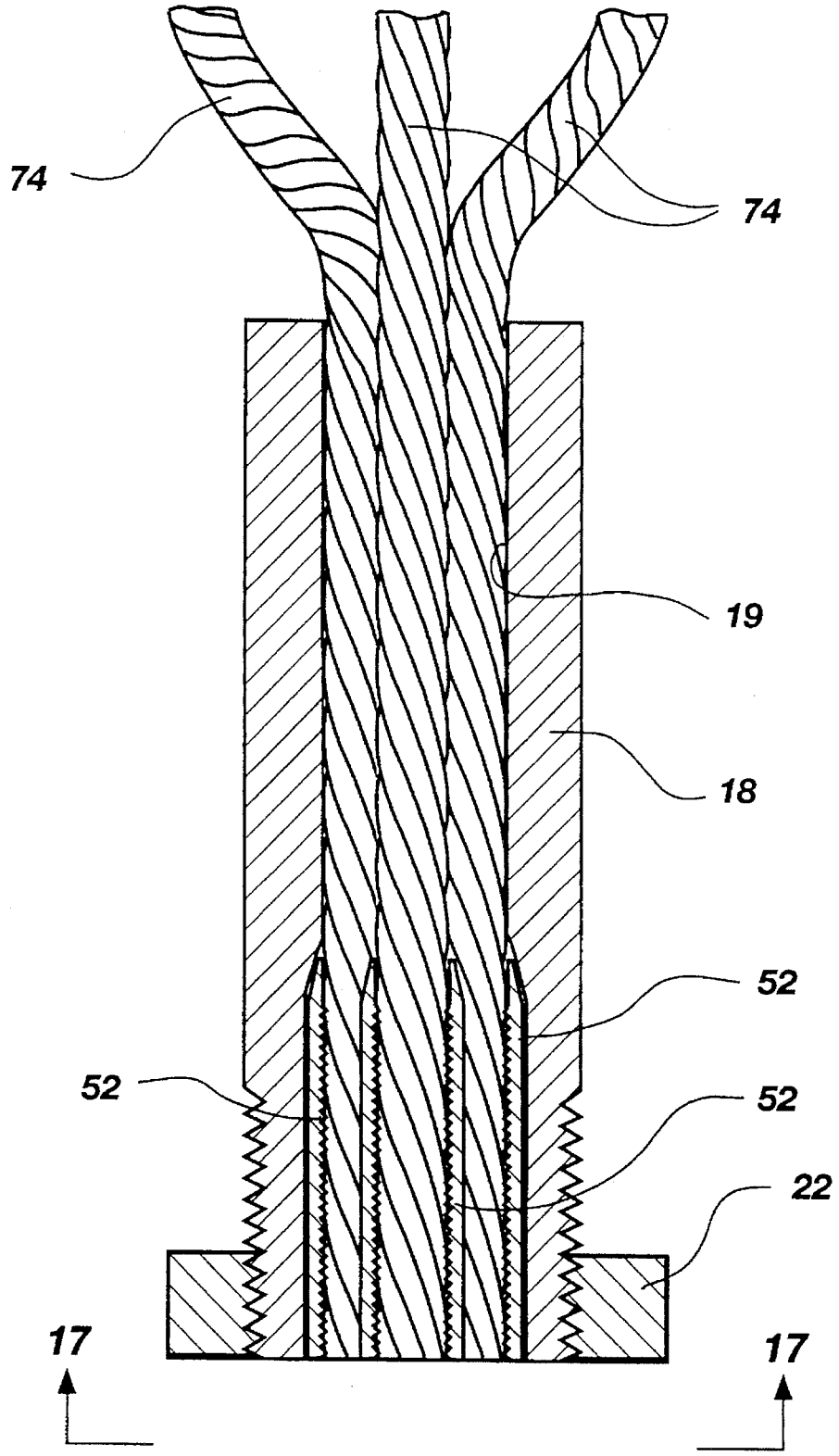
FIG. 16 is a view similar to FIG. 14, illustrating a plurality of cable bolt shafts utilizing the cable sleeve design of the cable enlarged sections.

FIG. 16 is a view similar to FIG. 14, illustrating a plurality (three in FIG. 16) of cable bolt shafts utilizing the cable sleeve design of the cable enlarged sections shown in and described with reference to FIGS. 7–11. The embodiment of FIG. 16 comprises three cable shafts 74 positioned within the outer sleeve 18, as in the FIG. 14 embodiment. Each of these cable shafts includes a cable sleeve 52 positioned directly around the cable shaft at the (lower) end of the cable shaft and outer sleeve. As in the embodiments of FIGS. 7–11, each of these cable sleeves 52 may be formed in a single cylindrical piece, two essentially identical semi-cylindrical pieces, or three essentially identical arcuate sections. The single cylindrical piece cable sleeve 52 preferably includes a longitudinal slit therein (not shown), as previously described, to facilitate installation of the sleeve onto the cable, and also to enable the sleeve to compress slightly as the cable and sleeve are pressed into and pulled through the outer sleeve 18 as the cable bolt yields.

Figure 17:
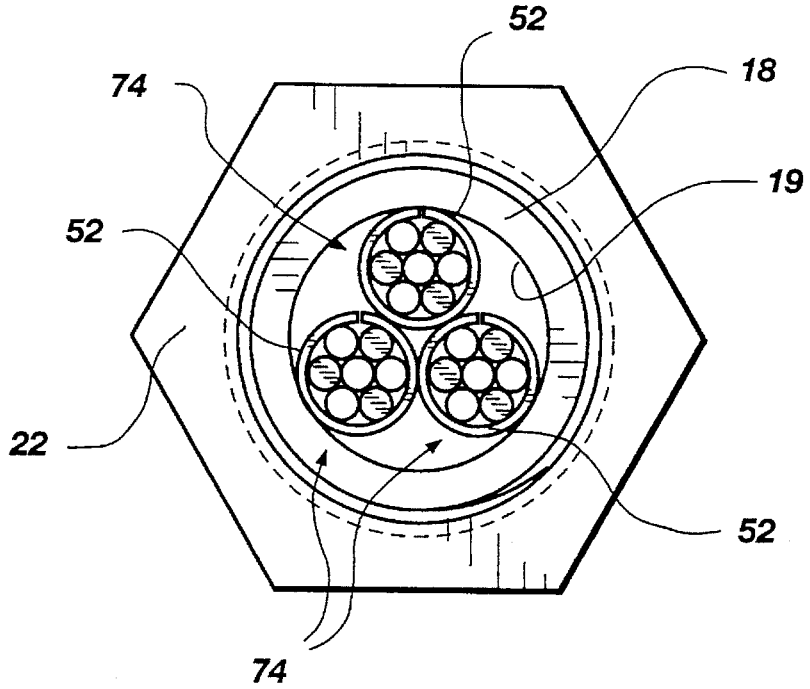
FIG. 17 is an end view of the FIG. 16 design taken in the direction of arrows 17 in FIG. 16.

FIG. 17 is an end view similar to FIG. 15 of the FIG. 16 embodiment taken in the direction of arrows 17 in FIG. 16. FIG. 17 illustrates the positions of the cable shafts 74, each including a cable sleeve 52 within the outer sleeve 18 to form the yieldable cable bolt. The yieldable cable bolt embodiment of FIGS. 16 and 17 functions in a manner identical to that of previously described embodiments to maintain a tension load up to a predetermined maximum amount, thereafter yield at that maximum amount for a predetermined distance within the particular mine tunnel roof rock formation. Those skilled in the art will also readily appreciate that the multiple cable shaft design of the yieldable cable bolt of FIGS. 14–17 may also be utilized with the alternative design of the outer sleeve 32, as shown in FIGS. 3 and 11, with equal efficacy.

From the foregoing, it will be seen that this invention is one well adapted to attain all of the ends and objectives herein set forth, together with other advantages which are obvious and which are inherent to the apparatus. It will be understood that certain features and subcombinations are of utility and may be employed with reference to other features and subcombinations. This is contemplated by and is within the scope of the claims. As many possible embodiments may be made of the invention without departing from the scope of the claims. It is to be understood that all matter herein set forth or shown in the accompanying drawings is to be interpreted as illustrative and not in a limiting sense.

What is claimed is:

1. A yieldable cable bolt comprising:

a length of multi-strand cable comprising a center wire and a plurality of peripheral wires spirally wrapped around the center wire;

a center wire sleeve positioned around the cable center wire and between the cable center wire and peripheral wires to define an enlarged cable section; and an outer sleeve having an inside diameter slightly less than the outside diameter of the enlarged cable section;

whereby the outer sleeve is positioned over the cable, and the enlarged cable section is pressed into one end of the outer sleeve to result in the cable bolt.

2. A yieldable cable bolt as set forth in claim 1, wherein the enlarged cable section deforms the inside diameter surface of the outer sleeve as tension force on the cable pulls the cable through the outer sleeve.

3. A yieldable cable bolt as set forth in claim 1, wherein the outer sleeve has external screw threads on an end thereof, and the cable bolt includes a nut screwed onto the outer sleeve external threads defining a bolt head.

4. A yieldable cable bolt as set forth in claim 1, wherein the outer sleeve is formed with a bolt head.

5. A yieldable cable bolt as set forth in claim 4, wherein the outer sleeve bolt head is formed with a semi-spherical washer surface.

6. A yieldable cable bolt as set forth in claim 1, wherein the center wire sleeve includes an axially oriented slit to permit the sleeve to expand slightly to facilitate installation on the cable center wire.

7. A yieldable cable bolt as set forth in claim 1, wherein the center wire sleeve is tapered at one end thereof.

8. A yieldable cable bolt as set forth in claim 1, further comprising a plurality of multi-strand cables, each of the cables having a respective center wire sleeve positioned around its center wire and between the cable center wire and peripheral wires to define respective cable enlarged sections.

9. A yieldable cable bolt as set forth in claim 1, further comprising slip prevention means for preventing the cable from slipping relative to resin adhesive material within a bore hole.

10. A yieldable cable bolt as set forth in claim 9, wherein the slip prevention means comprises an anchor sleeve mounted on the cable.

11. A yieldable cable bolt as set forth in claim 10, wherein the anchor sleeve includes outwardly projecting fins for centering the cable within the bore hole and for puncturing resin adhesive cartridges.

12. A yieldable cable bolt as set forth in claim 1, further comprising a stiffner sleeve mounted on the cable adjacent the outer sleeve for minimizing buckling of the cable as the cable bolt is being inserted into a bore hole, and for protecting the cable from damage from a mine roof bolt plate as the cable bolt is being rotated into a bore hole.

13. A yieldable cable bolt comprising:

a length of multi-strand cable comprising a center wire and a plurality of peripheral wires spirally wrapped around the center wire;

a cable sleeve positioned around the cable, the cable sleeve being tapered at one end thereof; and an outer sleeve having an inside diameter slightly less than the outside diameter of the cable sleeve;

whereby the outer sleeve is positioned over the cable, the cable and cable sleeve are pressed into one end of the outer sleeve to result in the cable bolt, and the cable sleeve deforms the inside surface of the outer sleeve as tension force on the cable pulls the cable through the outer sleeve.

14. A yieldable cable bolt as set forth in claim 13, wherein the outer sleeve has external screw threads on an end thereof, and the cable bolt includes a nut screwed onto the outer sleeve external threads defining a bolt head.

15. A yieldable cable bolt as set forth in claim 13, wherein the outer sleeve is formed with a bolt head.

16. A yieldable cable bolt as set forth in claim 15, wherein the outer sleeve bolt head is formed with a semi-spherical washer surface.

17. A yieldable cable bolt as set forth in claim 13, wherein the cable sleeve includes an axially oriented slit to permit the sleeve to expand slightly to facilitate installation on the cable.

18. A yieldable cable bolt as set forth in claim 13, wherein the cable sleeve comprises a plurality of partial sections, together defining the cable sleeve when positioned around the cable.

19. A yieldable cable bolt as set forth in claim 18, wherein the cable sleeve comprises two semi-cylindrical partial sections.

20. A yieldable cable bolt as set forth in claim 18, wherein the cable sleeve comprises three partial sections.

21. A yieldable cable bolt as set forth in claim 13, further comprising a plurality of multi-strand cables, each of the cables having a respective cable sleeve positioned around it.

22. A yieldable cable bolt as set forth in claim 13, further comprising slip prevention means for preventing the cable from slipping relative to resin adhesive material within a bore hole.

23. A yieldable cable bolt as set forth in claim 22, wherein the slip prevention means comprises an anchor sleeve mounted on the cable.

24. A yieldable cable bolt as set forth in claim 23, wherein the anchor sleeve includes outwardly projecting fins for centering the cable within the bore hole and for puncturing resin adhesive cartridges.

25. A yieldable cable bolt as set forth in claim 13, further comprising a stiffner sleeve mounted on the cable adjacent the outer sleeve for minimizing buckling of the cable as the cable bolt is being inserted into a bore hole, and for protecting the cable from damage from a mine roof bolt plate as the cable bolt is being rotated into a bore hole.

26. A yieldable cable bolt comprising:

a length of multi-strand cable comprising a center wire and a plurality of peripheral wires spirally wrapped around the center wire;

means defining an enlarged cable section of the cable;

an outer sleeve having an inside diameter slightly less than the outside diameter of the enlarged cable section, the cable being inserted through the outer sleeve, and the enlarged cable section being pressed into one end of the outer sleeve; and a plurality of anchor sleeves swaged onto the cable.

27. A cable bolt comprising:

a length of multi-strand cable comprising a center wire and a plurality of peripheral wires spirally wrapped around the center wire;

an enlarged cable section of the cable comprising a center wire sleeve positioned around the cable center wire and between the cable center wire and peripheral wires; and an outer sleeve positioned on the enlarged cable section to resist movement of the cable through the outer sleeve.

* * * * *